US009303611B2

(12) United States Patent
Wenckel et al.

(10) Patent No.: US 9,303,611 B2
(45) Date of Patent: Apr. 5, 2016

(54) STARTING DEVICE FOR AN INTERNAL COMBUSTION ENGINE

(75) Inventors: Mathias Wenckel, Hamburg (DE); Carsten Ziegs, Hamburg (DE)

(73) Assignee: MAKITA CORPORATION, Anjo (JP)

( * ) Notice: Subject to any disclaimer, the term of this patent is extended or adjusted under 35 U.S.C. 154(b) by 951 days.

(21) Appl. No.: 13/307,840

(22) Filed: Nov. 30, 2011

(65) Prior Publication Data

US 2012/0132170 A1 May 31, 2012

(30) Foreign Application Priority Data

Nov. 30, 2010 (DE) ..... 20 2010 016 015 U

(51) Int. Cl.
*F02N 5/02* (2006.01)
*F02N 3/02* (2006.01)
*F02N 15/06* (2006.01)

(52) U.S. Cl.
CPC .. *F02N 5/02* (2013.01); *F02N 3/02* (2013.01); *F02N 15/063* (2013.01); *F02N 15/065* (2013.01)

(58) Field of Classification Search
CPC ..... F02N 15/063; F02N 15/065; F02N 3/02; F02N 5/02
USPC ..... 123/185.14, 185.2, 185.3, 185.4; 185/39, 41 A, 41 C, 41 R
See application file for complete search history.

(56) References Cited

U.S. PATENT DOCUMENTS 4,291,654 A * 9/1981 Obermayer ..... 123/185.3
4,422,417 A * 12/1983 Obermayer ..... 123/185.3
4,480,605 A * 11/1984 Bloemers ..... 123/185.3
5,431,135 A * 7/1995 Tyler ..... 123/185.3
6,971,359 B2 * 12/2005 Tohyama ..... 123/185.3
7,069,896 B2 * 7/2006 Tsunoda et al. ..... 123/185.3
7,275,508 B2 * 10/2007 Pattullo ..... 123/179.18
7,287,505 B2 * 10/2007 Kruse et al. ..... 123/185.3

(Continued)

FOREIGN PATENT DOCUMENTS

AT 385 092 B 2/1988
CN 1459558 A 12/2003

(Continued)

OTHER PUBLICATIONS

May 9, 2012 Extended Search Report issued in European Application No. 11 18 9135 (with translation).
Jul. 11, 2011 German Search Report issued in German Patent Application No. 20 2010 016 015.4 (with translation).

(Continued)

*Primary Examiner* — Erick Solis
*Assistant Examiner* — Carl Staubach
(74) *Attorney, Agent, or Firm* — Oliff PLC

(57) ABSTRACT

A starting device for an internal combustion engine includes a pulley mounted rotatably in a housing which can be set in rotation by a tension means to produce a drive torque for a motor shaft by a starter handle and which is connected to an engaging member by a damping spring. The drive torque is transmitted to the motor shaft to start the internal combustion engine, whereby under torsion of the damping spring, a twisting of the pulley against the engaging member is rendered possible until a stop element impacts against a counter-stop to delimit the twisting, which enables a high operational readiness of the starting device. In the case of a defect of the damping spring, the stop element and/or the counter-stop is formed from a material which has a higher strength than the material of the engaging member and/or the material of the pulley.

10 Claims, 6 Drawing Sheets

Fig. 1

(56) References Cited

U.S. PATENT DOCUMENTS

| | | | | |
|---|---|---|---|---|
| 8,291,879 | B2 * | 10/2012 | Eakins, Jr. | 123/185.3 |
| 8,770,167 | B2 * | 7/2014 | Wenckel | 123/185.3 |
| 2003/0213455 | A1 | 11/2003 | Tohyama | |
| 2004/0084004 | A1 | 5/2004 | Tsunoda et al. | |
| 2004/0250786 | A1 | 12/2004 | Kruse et al. | |
| 2005/0252477 | A1 | 11/2005 | Schriever et al. | |
| 2008/0132302 | A1 * | 6/2008 | Schechtel et al. | 455/575.4 |
| 2010/0132650 | A1 | 6/2010 | Eakins, Jr. | |
| 2010/0170465 | A1 | 7/2010 | Eakins, Jr. | |

FOREIGN PATENT DOCUMENTS

| | | | |
|---|---|---|---|
| CN | 1696494 | A | 11/2005 |
| DE | 203 01 182 | U1 | 7/2004 |
| EP | 1 365 143 | A1 | 11/2003 |
| EP | 1 413 746 | A2 | 4/2004 |
| EP | 1 596 060 | A2 | 11/2005 |

OTHER PUBLICATIONS

Jan. 6, 2015 Office Action issued in Chinese Patent Application No. 201110397284.9.

* cited by examiner

STARTING DEVICE FOR AN INTERNAL COMBUSTION ENGINE

The present invention is directed towards a starting device for an internal combustion engine comprising a pulley mounted rotatably in a housing which can be set in rotational movement by means of a tension means to produce a drive torque for a motor shaft by means of at least one starter handle and which is connected to an engaging member by means of a damping spring formed from a spring wire, by which means the drive torque can be transmitted to the motor shaft to start the internal combustion engine, whereby under torsion of the damping spring, a twisting of the pulley against the engaging member is rendered possible until a stop element impacts against a counter-stop to delimit the twisting.

PRIOR ART

Document DE 203 01 182 U1 discloses a generic starting device for an internal combustion engine and a starter handle is connected to a tension means that is rolled on a pulley. If the user pulls on the starter handle, the pulley is set in rotation by means of the tension means and the rotation is transmitted by means of a damping spring to an engaging member by which means the drive torque can be transmitted to the motor shaft to start the internal combustion engine.

When a user pulls the starter handle and thereby sets the pulley in rotation, the angle of rotation of the pulley can already differ from the angle of rotation of the engaging member. If an internal combustion engine is being started by starting to turn the motor shaft by applying a torque, a non-uniform torque profile is obtained during rotation of the motor shaft due to the reciprocating piston principle of the internal combustion engine. In the compression phase a piston guided in the cylinder increases the torque and consequently acts against the drive torque. In the decompression phase on the other hand, a rotational movement of the motor shaft is supported and when the motor shaft begins to rotate, a periodic force profile having corresponding force peaks is consequently obtained. This therefore means that the torque to be applied to the motor shaft is subject to strong fluctuations which can be transmitted to the pulley and therefore also to the starter handle. In order to avoid or at least reduce the transmission of the force peaks from the engaging member that, when starting the internal combustion engine, is connected to the motor shaft, to the pulley, the damping spring is provided which allows a torsion between the pulley and the engaging member in order to be able to twist the engaging member towards the pulley at least in a predefined angular range. Consequently, the force peaks are only transmitted to the pulley to a reduced extent.

In order to limit the twisting of the engaging member with respect to the pulley and in order to thereby avoid damage to the damping spring due to overstressing, a stop element is provided which can come to abut against a counter-stop, whereby the maximum angle of twist of the engaging member with respect to the pulley is limited, so that the maximum torsion of the damping spring is also limited.

In the event of a break of the damping spring but also in the case of an elastic overstressing of the damping spring, an appreciable force can act on the stop of the stop element against the counter-stop due to the force peaks of the internal combustion engine. This can have the result that the stop element or the counter-stop element fails mechanically, in particular a rupture of the stop element or the counter-stop element can occur.

In order to increase the loading capacity of the stop, two stop elements can be provided which are disposed diametrically opposite to one another on the engaging member. Consequently, two stops can come to abut against a respective counter-stop in order to allow the maximum load-bearing capacity for transmission of a torque from the pulley to the engaging member if, for example, the damping spring is broken. Disadvantageously, however the maximum angle of twist is thereby halved since the stops are offset by a maximum of 180° with respect to one another.

If a rupture of the damping spring occurs, it is desirable to be able to further operate the starting device at least temporarily despite the broken damping spring. Such emergency operation of the starting device in the event of a defect of the damping spring can take place by transmitting a torque from the pulley to the engaging member directly via the stop element and the counter-stop element. If the stop element comes to abut against the counter-stop, a torque can be transmitted in this way from the pulley to the engaging member without however suppressing the force peaks from the internal combustion engine on the pulley. If, however, the internal combustion engine is started with a defective damping spring, the force peaks can cause a mechanical rupture of the stop element and/or the counter-stop and it is desirable to avoid this.

It is therefore the object of the present invention to provide a starting device for an internal combustion engine which allows a high operational readiness of the starting device, in particular in the case of a defect of the damping spring.

This object is solved starting from a starting device for an internal combustion engine according to the preamble of claim 1 in conjunction with the characterising features. Advantageous further developments of the invention are specified in the dependent claims.

DISCLOSURE OF THE INVENTION

The invention includes the technical teaching that the stop element and/or the counter-stop are formed from a material that has a higher strength than the material of the engaging member and/or than the material of the pulley.

The invention starts from the idea of forming the stop element and/or the counter-stop from a material that differs from the material of the engaging member and/or the material of the pulley. It is particularly advantageous to make the engaging member and/or the pulley from a plastic material, in particular in an injection moulding process. The plastic materials to be processed thereby have merely a low strength so that the problem described hereinbefore can arise that the stop element and/or the counter-stop undergo a mechanical rupture when, in the case of a defect in the damping spring, the force peaks upon starting the internal combustion engine are transmitted directly from the engaging member into the pulley. With the choice of materials according to the invention, the engaging member and/or the pulley can still be made of a favourable plastic material from the production technology viewpoint, where the stop element and/or the counter-stop can be formed from a different material, in particular from a higher-strength material so that failure of the stop element and/or the counter-stop does not experience any damage even when force peaks occur.

According to an advantageous embodiment, the stop element can be formed from a metal material, in particular from a steel material, where in particular the engaging member and/or the pulley are formed from a plastic material. Likewise, the counter-stop can be configured as an insert element made of a high-strength material, in particular as an insert element made of a metal material and be inserted in the pulley.

Preferably both the stop element for the engaging member and also the counter-stop for the pulley are over-moulded in a plastic injection moulding process so that the stop element and/or also the counter-stop are already inserted in an injection mould when the plastic material is injected into the mould.

According to one possible embodiment, the stop element can be disposed on the engaging member and project from a surface of the engaging member facing the pulley, in particular the stop element can be configured as a pin element or as a bolt element and extend from the surface of the engaging member facing the pulley in the direction of the pulley. A guide groove can be incorporated in the pulley, in which the stop element is guided, where the counter-stop engages in the guide groove. The maximum twisting of the engaging member with respect to the pulley can be limited by the stop element impacting against the counter-stop. Alternatively it is also possible to provide the stop element in the same way in the pulley and the guide groove can be incorporated in the engaging member.

Advantageously, the spring wire of the damping spring can have two ends and a first end can be in engagement with the engaging member and a second end can be in engagement with the pulley, where the counter-stop is formed from the spring wire of the damping spring, which in particular comprises a high-hardness metal material. According to the invention, the damping spring on the one hand fulfils the damping function between the pulley and the engaging member, on the other hand the damping spring forms the counter-stop against which the stop element can impact to limit the twisting of the engaging member with respect to the pulley.

In particular, the counter-stop can be formed from the second end of the spring wire of the damping spring that is in engagement with the pulley. The second end of the spring wire of the damping spring can have a curved shape, where the curved shape is encased with a first segment in a receptacle of the pulley for engagement therein and projects with a second segment from the receptacle of the pulley in the direction of the engaging member. The part of the second end which is encased in the receptacle of the pulley on the one hand fixes the damping spring in the pulley so that a torque can be applied from the pulley onto the damping spring and furthermore, the first segment of the second end which is encased in the receptacle fulfils a fixing of the second end so that the second segment projecting from the receptacle is rigidly connected to the pulley in order to form the counter-stop.

The curved shape of the second end of the spring wire of the damping spring can have an S shape, a C shape or an inverted U shape. At the same time, the second end of the spring wire of the damping spring can extend with its curved shape in one plane, in particular the S shape, the C shape or the inverted U shape can extend in one plane, where the damping spring has a central axis which lies in the plane of the second end. The plane is thus defined by the central axis and an axis running orthogonally to the central axis, and the second end of the spring wire extends approximately perpendicularly from the body of the damping spring. The second end of the spring wire can have any curved shape and the S shape, the C shape or the inverted U shape each form only one possible advantageous embodiment in order on the one hand to form the first segment which can be inserted in the receptacle of the pulley and in order on the other hand to form the second segment which serves as a counter-stop for the stop element. The inverted U shape thereby describes a "U" and the open side of the "U" is inserted in the receptacle so that only one loop of the spring wire projects from the receptacle as the second segment in order to form a rigid, loadable counter-stop.

In order to form the stop element and/or the counter-stop from a material that has a higher strength than the material of the engaging member and/or than the material of the pulley, the stop element and/or the counter-stop can merely be reinforced by a higher-strength material, for example, by a metal material. For example, the stop element and/or the counter-stop can be formed in one piece and of the same material using the material of the engaging member and/or using the material of the pulley and the stop element and/or the counter-stop is merely reinforced with a higher-strength material, for example, by a metal core or by a metal attachment.

BRIEF DESCRIPTION OF THE DRAWINGS

Further measures which improve the invention are presented in detail hereinafter jointly with the description of a preferred exemplary embodiment of the invention by reference to the figures. In the figures.

PREFERRED EXEMPLARY EMBODIMENTS OF THE INVENTION

Figure 1:
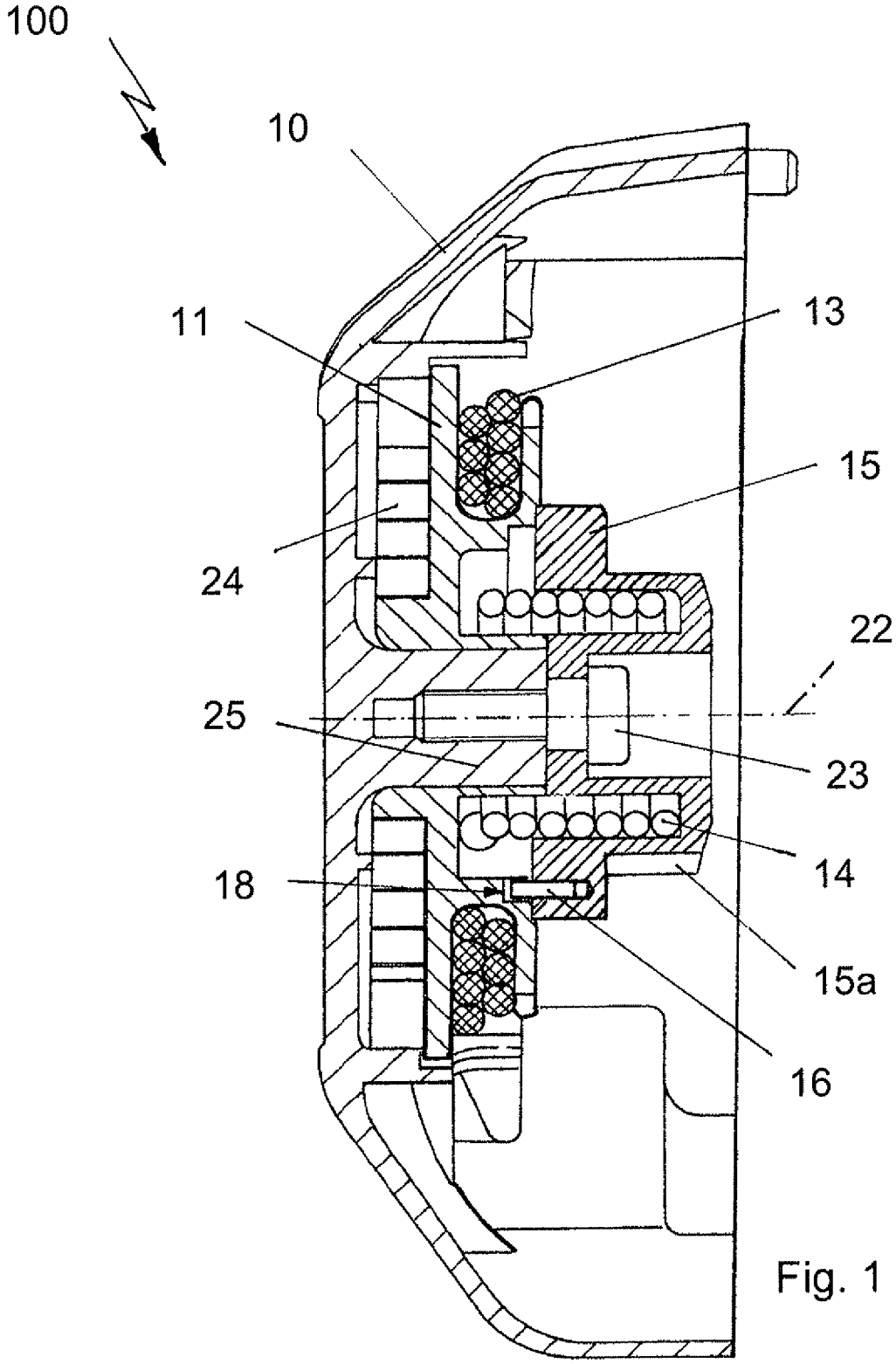
FIG. 1 shows an exemplary embodiment of a starting device in a cutaway view with the features of the present invention.

FIG. 1 shows an exemplary embodiment of a starting device 100 for an internal combustion engine having a pulley 11 mounted rotatably in a housing 10. A tension means 13 which is executed in the form of a cable is wound on the pulley 11. The pulley is mounted rotatably in the housing 10 and when one end of the tension means 13 is pulled manually, the pulley 11 is set in rotational movement. The pulley 11 is mounted rotatably about a central axis 22, where a damping spring 14 is shown, this spring being firmly connected with an end pointing towards the pulley 11 to said pulley in a manner not shown in detail. Located on the side of the damping spring 14 opposite the pulley 11 is an engaging member 15 and the end of the damping spring 14 pointing in the direction of the engaging member 15 is connected in a torque-resistant manner to the engaging member 15. Consequently, the damping spring 14 forms a torsion element that connects the pulley 11 to the engaging member 15 in a torsionally elastic manner. Due to the torsional elasticity of the damping spring 14, a relative movement can therefore take place between the pulley 11 and the engaging member 15.

If the pulley 11 is set in rotational movement by pulling on the tension means 13, the damping spring 14 also co-rotates about the central axis 22. The engaging member 15 is thereby also set in rotational movement, which member can engage via an engaging contour 15*a* in detent elements not shown in detail, by which means the motor shaft of the internal combustion engine can be turned. The pulley 11, the damping spring 14 and the engaging member 15 are accommodated rotatably via a central screw 23 on a bearing mandrel 25 which is formed as part of the housing 10. A return spring 24 serves to turn the pulley 11 back again opposite to the direction of rotation when the tension means 13 is released again. When pulling on the tension means 13, the pulley 11 is turned in the direction of rotation of the motor shaft whilst the tension means 13 is unwound from the pulley 11. The return spring 24 is then used to drive the pulley 11 to rotate in the opposite direction again, so that the tension means 13 can be wound on again.

A stop element 16 is inserted in the engaging member 15 which is designed, for example, as a bolt element and is disposed in a hole incorporated in the engaging member 15. The bolt-like stop element 16 is made of a steel material and projects a little distance from the surface of the engaging member 15 pointing in the direction of the pulley 11. Corresponding to the arrangement of the stop element 16, a guide groove 18 is introduced in the pulley 11 and when a relative rotation of the engaging member 15 takes place under simultaneous torsion of the damping spring 14 with respect to the pulley 11, the stop element 16 runs in the guide groove 18 until the stop element 16 comes to abut against a counter-stop not shown in detail.

Figure 2:
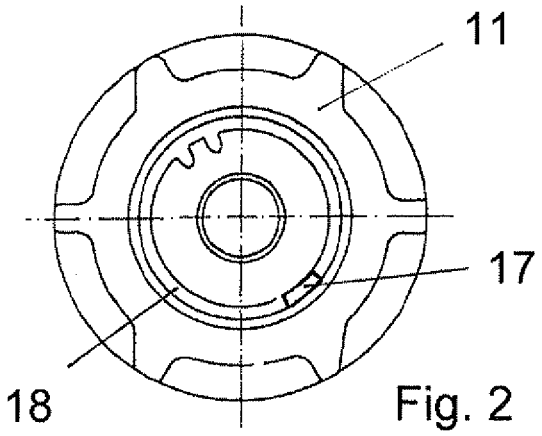
FIG. 2 shows a view of a pulley with a counter-stop.

FIG. 2 shows a view of the pulley 11 from the direction in which the pulley 11 points towards the engaging member 15. The guide groove 18 is shown in the surface of the pulley 11 shown and a counter-stop 17 is incorporated in the course of the guide groove 18. The counter-stop 17 is shown, for example, as a metal insert element and the pulley 11 is made of a plastic material so that the counter-stop 17 according to the invention comprises a higher-strength material than the pulley 11.

Figure 3:
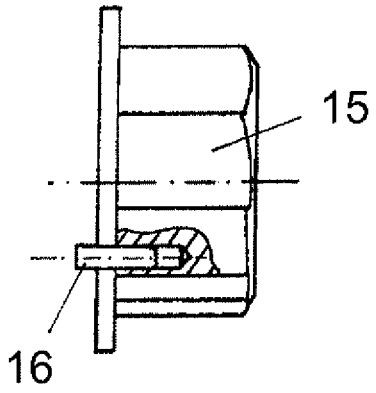
FIG. 3 shows a side view of an engaging member in which a stop element is incorporated.

FIG. 3 shows a side view of the engaging member 15 in which a stop element 16 is inserted, this being designed as a bolt element and consisting of a steel material. The engaging member 15 on the other hand is made of a plastic material so that the stop element 16 according to the invention comprises a higher-strength material than the engaging member 15.

Figure 4:
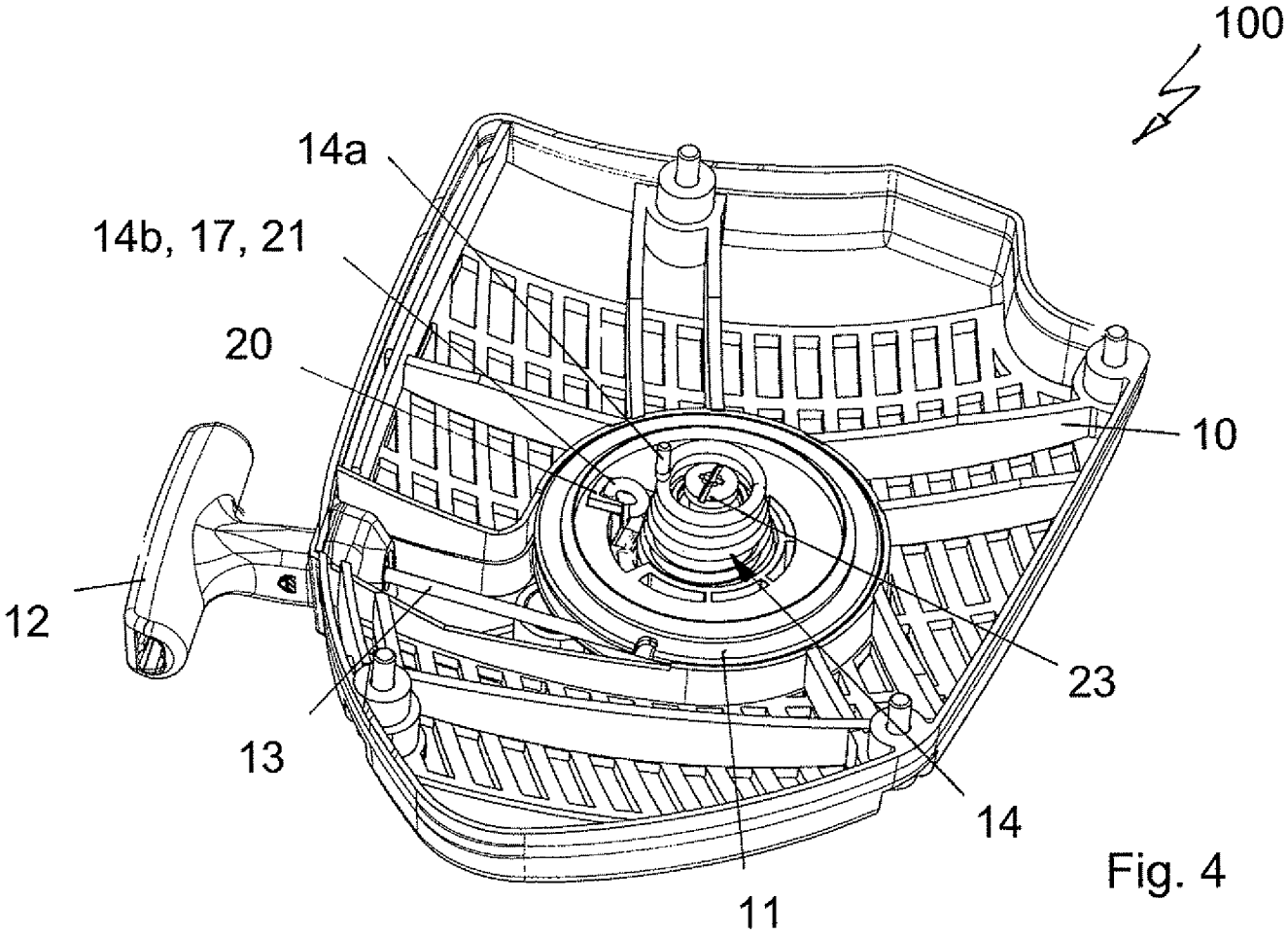
FIG. 4 shows a perspective view of the starting device according to another exemplary embodiment.

FIG. 4 shows another exemplary embodiment of a starting device 100 with a housing 10 which rotatably accommodates a pulley 11. A damping spring 14 is also shown where, for the perspective view of the pulley 11 and the arrangement of the damping spring 14, the engaging member 15 is removed, with the central screw 23 being shown, which indicates the axis of rotation of the pulley 11 and the damping spring 14. A starter handle 12 is also shown, which is disposed at the end on the tension means 13. If a tensile force is introduced manually via the starter handle 12 into the tension means 13, the pulley 11 is brought into rotation about the central screw 23.

The damping spring 14 has a first end 14*a* by which means the damping spring 14 is connected to the engaging member 15 not shown in detail. The damping spring 14 further comprises a second end 14*b* which is rigidly disposed in the pulley 11.

For the rigid arrangement of the second end 14*b* of the damping spring 14 in the pulley 11, this has a receptacle 20 and the second end 14*b* of the damping spring 14 is inserted with a first segment in the receptacle 20. A second segment 21 of the second end 14*b* of the damping spring 14 projects from the receptacle 20 and forms the counter-stop 17 against which a stop element 16 of the engaging member 15 is brought to abut when the angle of twist of the pulley 11 with respect to the engaging member 15 reaches a maximum. The second segment 21 of the second end 14*b* of the damping spring 14 projects from the receptacle 20 in a loop-like manner and the damping spring 14 is made of a high-strength metal material and the material of the damping spring 14 is harder than the material of the pulley 11 which is preferably made of plastic.

Figure 5:
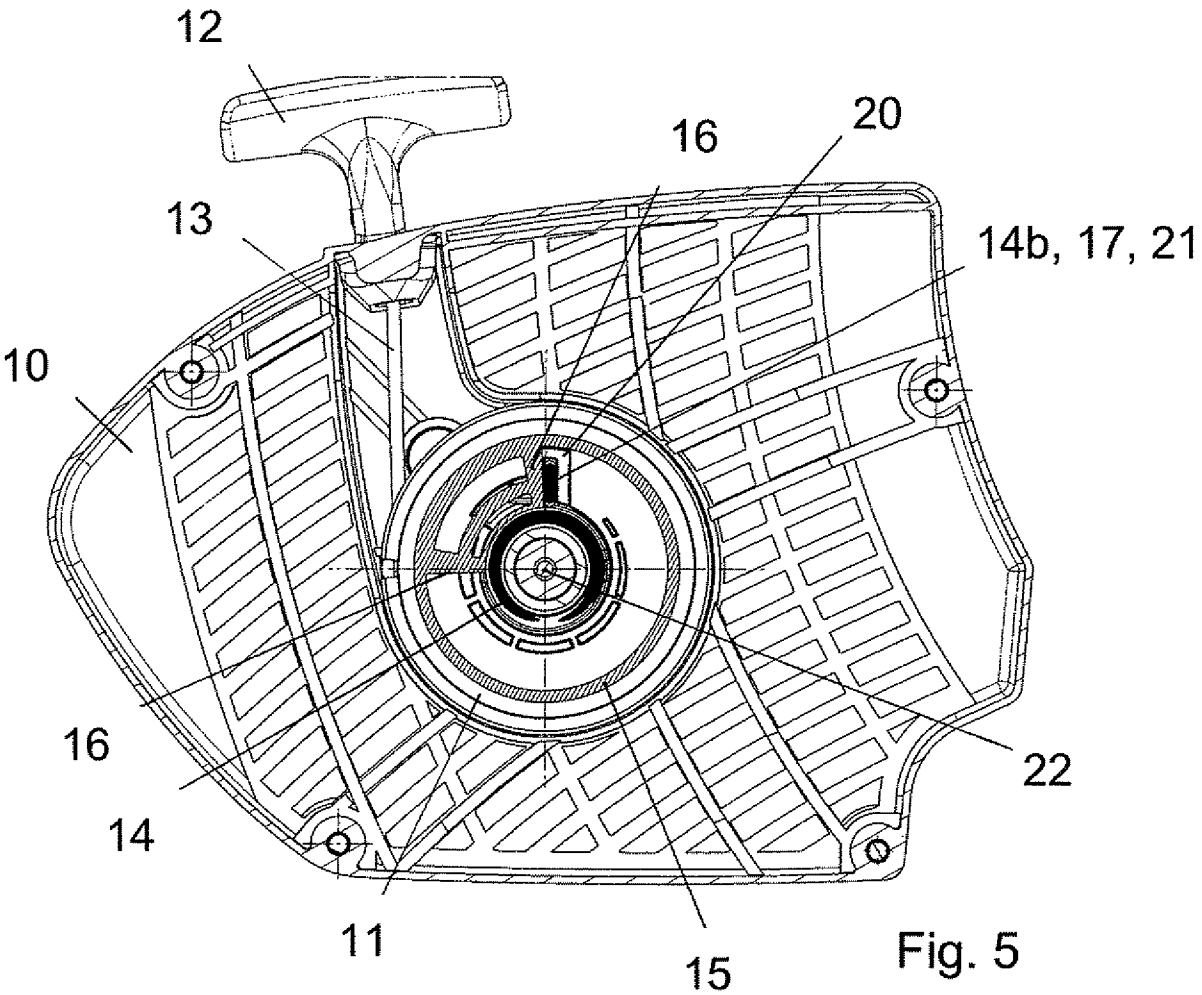
FIG. 5 shows a perspective view of the starting device according to the exemplary embodiment in FIG. 4.

FIG. 5 shows the engaging member 15 in a cutaway view and this has a first stop surface for forming the stop element 16 and the second segment 21 of the second end 14*b* of the damping spring 14 which projects from the receptacle 20 of the pulley 11 abuts against the first stop surface of the stop element 16. If a tensile force is introduced into the tension means 13 via the starter handle 12, and if the pulley 11 is set in rotation clockwise about the central axis 22, the pulley 11 can twist so far against the engaging member 15 that the counter-stop 17 formed by the second segment 21 of the second end 14*b* of the damping spring 14 comes to abut against the second stop surface of the stop element 16. The pulley 11 thereby twists through 270° with respect to the engaging member 15.

Figure 6:
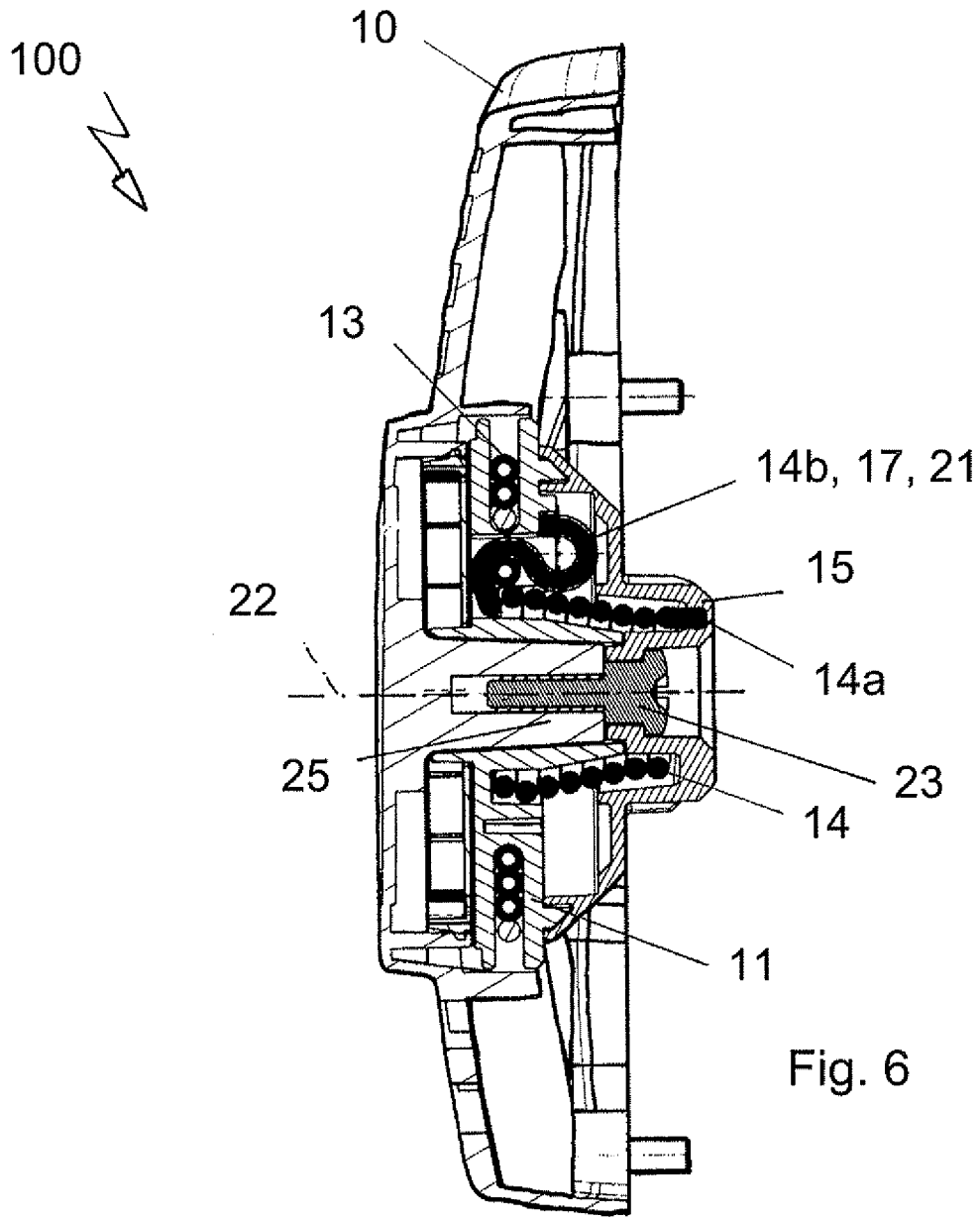
FIG. 6 shows a transverse cutaway side view of an exemplary embodiment of the starting device according to the exemplary embodiment from FIG. 4 and FIG. 5.

FIG. 6 shows a transverse cutaway side view of the starting device according to the exemplary embodiment from FIGS. 4 and 5. The housing is shown in a cutaway view and the pulley 11 with the tension means 13, the damping spring 14 and the engaging member 15 are fastened rotatably about the central axis 22 by means of the central spring 23 on the bearing mandrel 25 of the housing 10. In the transverse cutaway view of the damping spring 14, the first end 14*a* and the second end 14*b* of the damping spring 14 can be identified. The first end 14*a* is firmly connected to the engaging member 15, where the second end 14 has an S shape and a second segment 21 projects from the pulley 11 in order to form the counter-stop 17. A stop element of the engaging member 15 can come to abut against the counter-stop 17 when the engaging member 15 reaches the maximum angle of twist relative to the pulley 11.

Figures 7A, 7B, 7C:
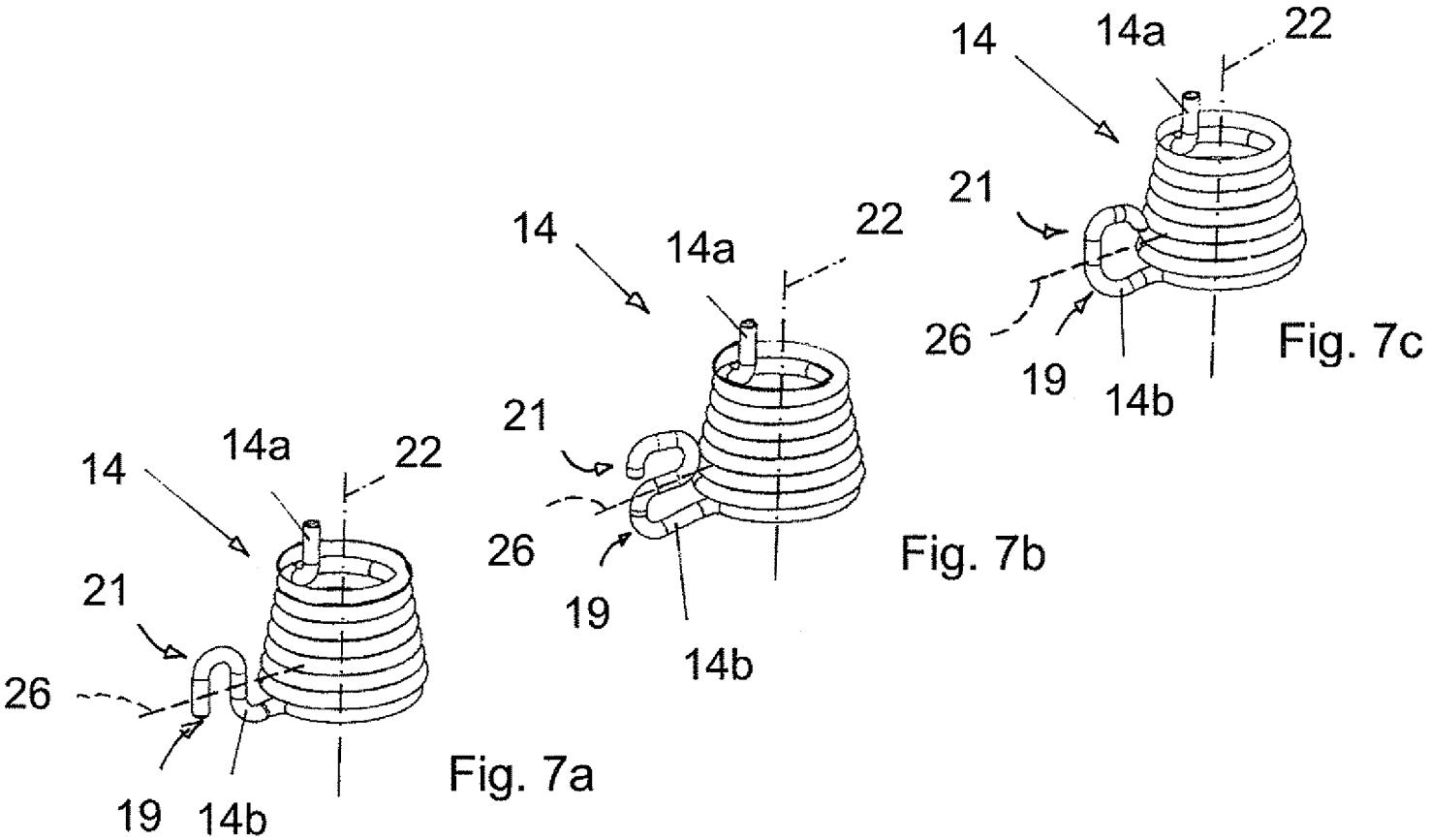
FIG. 7*a* shows a perspective view of a damping spring according to a first exemplary embodiment.
FIG. 7*b* shows a perspective view of a damping spring according to a second exemplary embodiment and FIG. 7*c* shows a perspective view of a damping spring according to a third exemplary embodiment.

FIGS. 7*a*, 7*b* and 7*c* each show respective exemplary embodiments of the damping spring 14 which extend about the central axis 22. The damping springs 14 are designed as helical springs and have a conical shape. The end of the conical shape of the damping spring 14 having the smaller diameter forms the first end 14*a* which is connected to the engaging member 15. The second end 14*b* is formed on the larger diameter of the conical shape and extends in a plane away from the damping spring 14 and the plane is defined by the central axis 22 and the direction of extension 26 of the second end 14*b* of the damping spring 14.

FIG. 7*a* shows a damping spring 14 with a second end 14*b* which is configured in the form of an inverted "U". The direction of extension 26 is shown at a height which separates the first segment 19 of the curved form of the second end 14*b* from the second segment 21. The first segment 19 is used for insertion in the receptacle 20 in the pulley 11 and the second segment 21 projects from the receptacle 20 of the pulley 11 in order to form the counter-stop 17.

FIG. 7*b* shows an S shape of the second end 14*b* where the direction of extension 26 is shown at half S height. Consequently the lower first segment 19 of the S shape can be inserted in the receptacle 20 and the upper second segment 21 projects from the receptacle 20.

FIG. 7*c* shows a C shape of the second end 14*b* of the damping spring 1 and the lower first segment 19 can again be inserted into the receptacle 20 whilst the upper second segment 21 projects from the receptacle 20 in order to form the counter-stop 17.

The invention is not restricted in its execution to the preferred exemplary embodiment specified hereinbefore. On the contrary, a number of variants are feasible which make use of the solution presented in fundamentally different embodiments. All the features and/or advantages deduced from the claims, the description or the drawings, including constructive details or spatial arrangements, can be essential for the invention both for themselves and in various combinations.

REFERENCE LIST

100 Motor-driven implement
10 Housing
11 Pulley
12 Starter handle
13 Tension means
14 Damping spring
14*a* First end
14*b* Second end
15 Engaging member
15*a* Engaging contour
16 Stop element
17 Counter-stop
18 Guide groove
19 First part of curved shape
20 Receptacle
21 Second part of curved shape
22 Central axis
23 Central screw
24 Return spring
25 Bearing mandrel
26 Direction of extension

The invention claimed is:

1. A starting device for an internal combustion engine comprising:

a pulley mounted rotatably in a housing;

a tensioning member configured to rotate the pulley in response to a force introduced via a starter handle, the pulley being configured to produce a drive torque for a motor shaft;

an engaging member coupled with the pulley by a damping spring formed from a spring wire, the damping spring being configured to transmit the drive torque to the motor shaft to start the internal combustion engine;

a stop element arranged on the engaging member; and a counter-stop arranged on the pulley, wherein under torsion of the damping spring, the pulley is rotatable relative to the engaging member until the stop element impacts against the counter-stop, the stop element and/or the counter-stop is formed from a material which has a higher strength than a material of the engaging member and/or a material of the pulley, and the stop element is made of a metal material, and the engaging member and/or the pulley is formed from a plastic material, the counter-stop is configured as an insert element made of a high-strength material, and is inserted in the pulley, and the counter-stop is statically coupled relative to the pulley.

2. The starting device according to claim 1, wherein the stop element is disposed on the engaging member and projects from a surface of the engaging member facing the pulley, wherein the stop element is configured as a pin or bolt and extends from the surface of the engaging member facing the pulley in a direction of the pulley.

3. The starting device according to claim 1, wherein the pulley includes a guide groove in which the stop element is guided, and the counter-stop engages the stop element in the guide groove.

4. The starting device according to claim 1, wherein the spring wire of the damping spring has two ends, a first end of the spring wire is in engagement with the engaging member, and a second end of the spring wire is in engagement with the pulley, and the counter-stop is formed from the spring wire of the damping spring, which comprises a high-hardness metal material.

5. The starting device according to claim 4, wherein the counter-stop is formed from the second end of the spring wire of the damping spring that is in engagement with the pulley.

6. The starting device according to claim 4, wherein the second end of the spring wire of the damping spring has a curved shape, wherein a first segment of the curved shape is encased in a receptacle of the pulley for engagement therein, and a second segment of the curved shape projects from the receptacle of the pulley in a direction of the engaging member.

7. The starting device according to claim 6, wherein the curved shape of the second end of the spring wire of the damping spring has a S shape, or a C shape, or an inverted U shape.

8. The starting device according to claim 6, wherein the second end of the spring wire of the damping spring extends with the curved shape in one plane, wherein the damping spring has a central axis which lies in the one plane of the second end.

9. The starting device according to claim 1, wherein the counter-stop is made of a metal material, and the engaging member and the pulley are formed from a plastic material.

10. The starting device according to claim 1, wherein the engaging member is formed from a plastic material.

* * * * *